US010076223B1

(12) United States Patent
Madril et al.

(10) Patent No.: US 10,076,223 B1
(45) Date of Patent: Sep. 18, 2018

(54) LOCKING VICE GRIP MOP

(71) Applicant: Jeronimo Madril, Tucson, AZ (US)

(72) Inventors: Jeronimo Madril, Tucson, AZ (US); Thomas Clinton Brown, Tucson, AZ (US)

(73) Assignee: Jeronimo Madril, Tucson, AZ (US)

( * ) Notice: Subject to any disclaimer, the term of this patent is extended or adjusted under 35 U.S.C. 154(b) by 252 days.

(21) Appl. No.: 15/215,314

(22) Filed: Jul. 20, 2016

Related U.S. Application Data

(60) Provisional application No. 62/194,777, filed on Jul. 20, 2015.

(51) Int. Cl.
*A47L 13/46* (2006.01)
*A47L 13/24* (2006.01)

(52) U.S. Cl.
CPC ..... *A47L 13/46* (2013.01); *A47L 13/24* (2013.01)

(58) Field of Classification Search
CPC ..... A47L 13/46; A47L 13/24
USPC ..... 15/150
See application file for complete search history.

(56) References Cited

U.S. PATENT DOCUMENTS 930,546 A * 8/1909 Hoover ..... A47L 13/46 15/150
959,131 A * 5/1910 Gabel ..... A47L 13/46 15/145
1,033,972 A * 7/1912 Westburg ..... A47L 13/46 15/150
1,049,282 A * 12/1912 Westburg ..... A47L 13/46 15/150
1,903,018 A * 3/1933 Wohlhieter ..... A47L 13/46 15/150
2,683,886 A * 7/1954 Neumann ..... A47L 13/12 15/114
2,864,110 A * 12/1958 Usher ..... B25G 3/00 15/144.4
2,895,152 A 7/1959 Vosbikian et al.
3,496,616 A * 2/1970 Vazquez ..... B25B 9/02 15/150
4,044,413 A * 8/1977 Tucker ..... B25B 7/02 7/125
4,694,524 A * 9/1987 Kim ..... A47L 13/254 15/105
2004/0016072 A1 1/2004 Libman et al.

OTHER PUBLICATIONS

"The Original Curved Jaw Locking Pliers with Wire Cutter," Irwin Tools, year 2018, 5 pages. Retrieved from http://www.irwin.com/tools/locking-tools/the-original-curved-jaw-locking-pliers-with-wire-cutter.

* cited by examiner

*Primary Examiner* — Weilun Lo
(74) *Attorney, Agent, or Firm* — David Goren; Fish & Richardson P.C (SV)

(57) ABSTRACT

A mop includes a handle, a mop head, and a locking vice clamp attached to a bottom end of the handle. The vice clamp has two jaws to hold the mop head and a movable arm to lock the jaws in a closed position.

8 Claims, 5 Drawing Sheets

LOCKING VICE GRIP MOP

CROSS-REFERENCE TO RELATED APPLICATIONS

This application claims priority to U.S. Provisional Application Ser. No. 62/194,777, filed on Jul. 20, 2015, the entirety of which is incorporated by reference.

TECHNICAL FIELD

This invention relates to mops, and more particularly to mops with a locking vice clamp for the mop head.

BACKGROUND

A typical mop includes a long handle with a mop head attached at one end. Types of mops include the following: flat mops, in which the mop head has a disposable pad with a flat face; sponge mops, in which the mop head includes a sponge and the mop often has an attached wringer; dust mops, in which the mop head tends to be long and flat and formed of microfiber to attract dust; string mops, in which the mop head is formed of long strings of cotton or synthetic material; and strip mops, which are similar to string mops but in which the mop head is formed of wider strips of synthetic material.

In many conventional mops, e.g., wet string mops, the mop head is fixed to the handle in a manner that the mop head can't be manually removed. That is, the mop head can't be detached without being physically broken or without use of a screwdriver or similar tool to loosen a mechanical fixture. However, there are some mops in which the mop head can be manually removed, e.g., the end of the handle has a screw to engage a threaded receiving recess in the mop head, and the mop head is removed by unscrewing the mop head from the handle. In addition, there are some mops, e.g., flat mops, wet mops, or sponge mops, in which a clamping mechanism holds the mop head at the bottom of the handle.

SUMMARY

In one aspect, a mop includes a handle, a mop head, and a locking vice clamp attached to a bottom end of the handle. The vice clamp has two jaws to hold the mop head and a movable arm to lock the jaws in a closed position.

In another aspect, a mop includes a handle and a locking vice clamp attached to a bottom end of the handle. The vice clamp has two jaws configured to hold a mop head and a movable arm to lock the jaws in a closed position.

In another aspect, a mop includes a handle and a locking vice clamp attached to a bottom end of the handle, and a rotatable knob. The vice clamp has two jaws configured to hold a mop head, and the rotatable knob adjusts a spacing between the jaws in a closed position.

Implementations of any aspect may include one or more of the following features. The jaws may include a pair of substantially flat paddles. Surfaces of the paddles may be positioned substantially perpendicular to a longitudinal axis of the handle. Surfaces of the paddles may be positioned substantially parallel to a longitudinal axis of the handle.

The locking vice clamp may include a shank connecting a fixed jaw of the two jaws to the handle, the shank may include a passage therein, and a stopper may be positioned in the passage to control a spacing between the jaws in the closed position. The stopper may be in a threaded engagement with the passage. The shank may include at least one aperture to expose a head of the stopper, the aperture sized to permit a user to turn the head and thus adjust a position of the stopper along the shank.

The locking vice clamp may include a fixed arm. The bottom end of the handle may be molded around the fixed arm, the bottom end of the handle may be welded to the fixed arm, the bottom end of the handle may be adhesively attached to the fixed arm, or the bottom end of the handle may be secured to the arm by a threaded engagement.

The mop head may be a string mop head having a plurality of strings. Inner surfaces of the jaws may be configured to clamp a carrier substrate from which the strings emerge. The two jaws may have a width of about 6 to 10 inches. The locking vice clamp may include a fixed jaw and a movable jaw. A clamping surface of the fixed jaw may be oriented substantially perpendicular to a long axis of the handle. A clamping surface of the fixed jaw may be oriented substantially parallel to a long axis of the handle. A clamping surface of at least one of the fixed jaw and the movable jaw may have ridges.

The vice clamp may include a rotatable knob used to adjust the spacing between the jaws in a closed position. This rotatable knob may have an inner threaded surface and be attached to a shank with an outer threaded surface. Rotation of the knob may cause the shank to move linearly. The locking vice clamp may also include a lever attached to the movable jaw, which can be used to lock the jaws in place when the lever is sufficiently rotated. The shank may be attached to the lever by a pivot pin, with the shank providing the stationary point when the lever is moved.

The vice clamp may also include a pin passing through the fixed jaw. The pin may be pressed by the pivot pin when the vice clamp is closed, causing the pin to extend past the fixed jaw. Downward pressure on the pin may unlock the vice clamp. The clamping surface may be elongated and oriented substantially perpendicular to the long axis of the handle. The clamping surface may be cylindrical or flat.

Advantages may include one or more of the following. The mop head can be periodically replaced, so that the mop head remains clean, reducing the risk of unsanitary conditions. The vice clamp can be locked in a closed position, reducing the risk that the mop head detaches accidentally from the handle. It does not require significant pressure to lock or unlock the vice clamp, so the mop can still be used by people with limited strength, e.g., elderly or disabled people.

The details of one or more embodiments are set forth in the accompanying drawings and the description below. Other aspects, features, and advantages will be apparent from the description and drawings, and from the claims.

DESCRIPTION OF DRAWINGS

Like reference symbols in the various drawings indicate like elements.

DETAILED DESCRIPTION

As noted above, there are some mops in which the mop head can be manually removed, e.g., by unscrewing the mop head from the handle. However, removing the mop head may require handling the mop head, which is unsanitary. In addition, the vibration of mopping can cause the screw to loosen. Placement of a clamping mechanism at the bottom end of the handle can permit a release handle to be spaced away from the mop head, so that the mop head does not have to be touched for removal. However, the clamping mechanism can open accidentally. By using a locking vice clamp, the mop head, e.g., for wet string mop, can be reliably attached to the handle.

Figure 1:
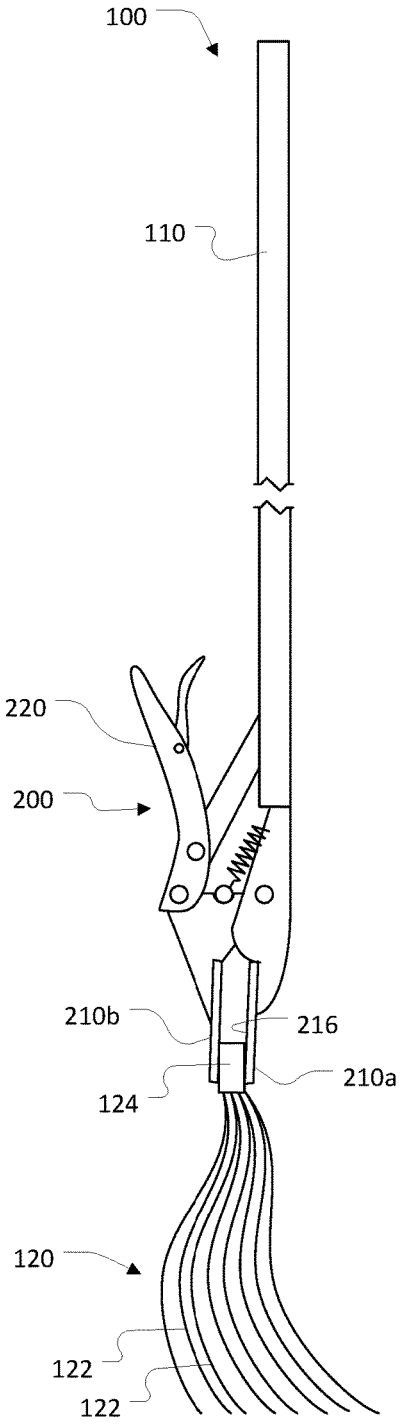
FIG. 1 is a schematic side view of a mop.
Figure 2:
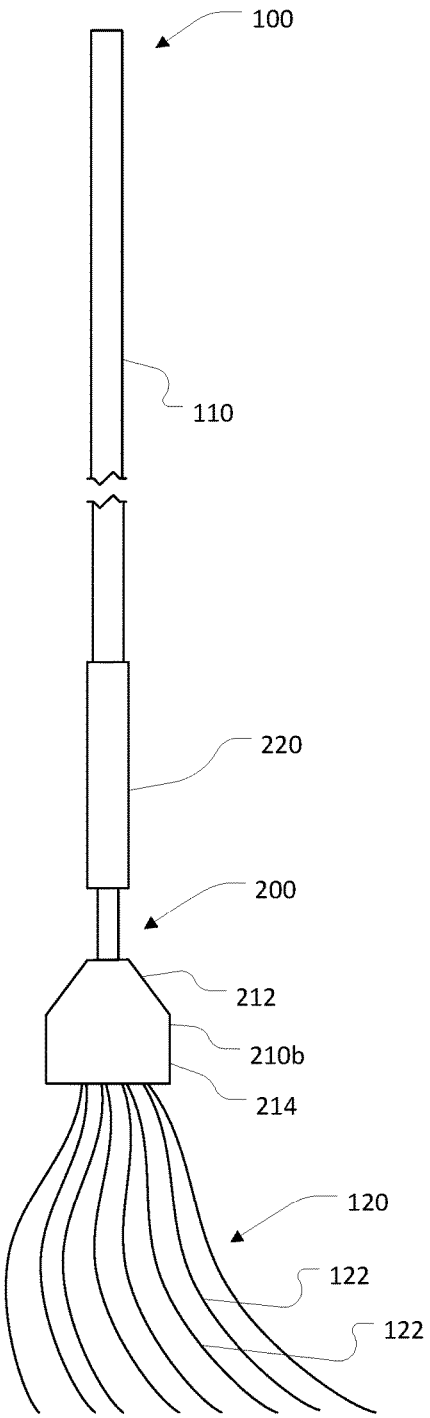
FIG. 2 is a schematic front view of the mop of FIG. 1.

Referring to FIGS. 1 and 2, a mop 100 includes a handle 110, a mop head 120, and a locking vice clamp 200 at the bottom end of the handle 110 to manually secure and manually release the mop head 120 to and from the handle 110. Manually in this context indicates that the vice clamp can be opened or closed by hand by the user, without requiring tools such as a screwdriver or wrench.

The handle 110 can be a cylindrical shaft formed of metal, wood or plastic. The handle 110 can be about 3 to 6 feet long. The surface of the handle 110 can be corrugated or have other surface texture to make the handle 110 easier to grip.

The mop head 120 illustrated in FIGS. 1 and 2 is a mop head for a string mop (sometimes also known as a wet mop). The mop head 120 includes a plurality of flexible strings 122 that emerge from a carrier substrate 124. For example, the strings 122 can be sewn together at their ends, e.g., by machine stitching, and can be attached to the carrier substrate 124 by machine stitching. The strings 122 can be cotton, or another absorbent material. The carrier substrate 124 can be a molded plastic, vinyl, or heavy fabric. In some implementations, the ends of the strings 122 are simply stitched together, and there is no carrier substrate. In addition, the mop head can be a strip mop head rather than a string mop head.

The vice clamp 200 fixed to the bottom end of the handle 110 in a manner that the vice clamp 200 can't be manually removed. For example, the bottom end of the handle 110 can be molded around an arm of the vice clamp 200, the vice clamp 200 can be welded to the bottom end of the handle 110, or the vice clamp can be secured with adhesive, screws or bolts to the bottom end of the handle 110.

As shown in FIG. 1, the carrier substrate 124 (if present) and/or the ends of the strings 122 are clamped between two jaws 210*a*, 210*b* of the vice clamp 200. As shown in FIG. 2, each jaw 210*a*, 210*b* can have a paddle shape that widens from a narrow section that is closer to the handle 110 to a wider section 214 that is farther from the handle. The wider section 214 of each paddle 210*a*, 210*b* can be about 6 to 10 inches across. The inside facing surfaces 216 of the paddles 210*a*, 210*b* can have ridges or other texturing to increase the grip of the vice clamp 200 on the mop head 120.

The vice clamp 200 also includes a locking/release handle 232 that can be pushed to cause the paddles 210*a*, 210*b* to clamp together to hold a mop head 120, or pulled to cause the clamping paddles 210*a*, 210*b* to move apart and release the mop head 120.

Figure 3:
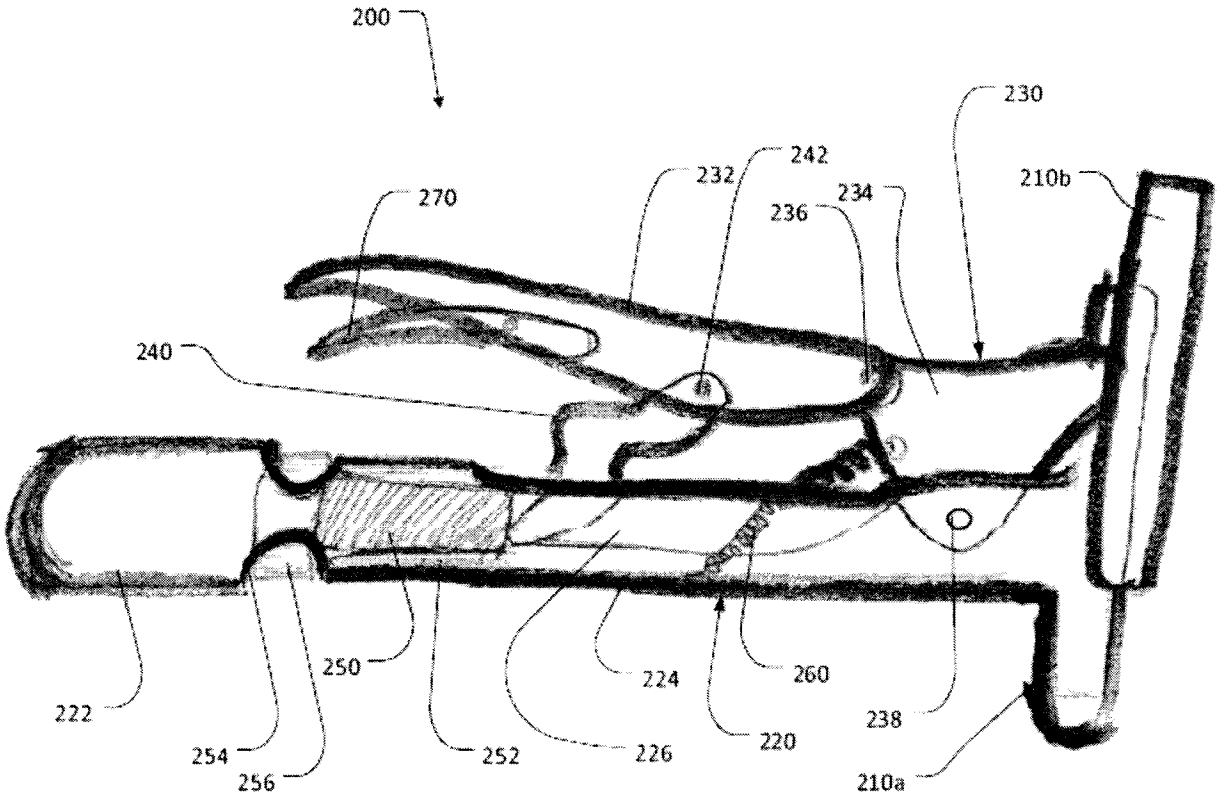
FIG. 3 is an expanded cross-sectional view of the vice grip portion of the mop of FIG. 1.

FIG. 3 illustrates the vice clamp 200 in a closed position. The vice clamp 200 includes a fixed arm 220 that is fixed to the bottom end of the handle, and a movable arm 230 that is pivotally attached to the fixed arm 220. The fixed arm 220 can include a knob 222 at one end, a fixed jaw 210*a*, and a shank 224 that extends between the knob 222 and the jaw 210*a*. The knob 222 is secured in an opening in the bottom end of the handle, e.g., by a threaded engagement, molding of the handle over the knob, or adhesive. A portion 226 of the shank 224 is hollowed out to provide a recess that provides room for various components.

The movable arm 230 includes the release handle 232 and a jaw body 234 that ends in the movable jaw 210*b*. An end of the release handle 232 closer to the jaws 210*b* is pivotally connected to the jaw body 234 by a pivot pin 236. The jaw body 234 is also pivotally connected to the shank 224 of the fixed arm 220 by a pivot pin 238.

As shown in FIG. 3, the fixed jaw 210*a* is oriented with its inside facing surface substantially perpendicularly to the shank 224 and thus to the longitudinal axis of the handle 110. Similarly, when in the closed position, the inside facing surface of the movably jaw 210*b* is substantially parallel to the inside facing surface of the fixed jaw 210*a*, and is thus similarly substantially perpendicular to the shank 224 and the longitudinal axis of the handle 110. Alternatively, as shown in FIGS. 1-2, the fixed jaw 210*a* can be oriented with its inside facing surface substantially parallel to the shank 224 and thus to the longitudinal axis of the handle 110. Again, when in the closed position, the inside facing surface of the movable jaw 210*b* is substantially parallel to the inside facing surface of the fixed jaw 210*a*, and is thus similarly substantially parallel to the shank 224 and the longitudinal axis of the handle 110. Of course, the fixed jaw 210*a* can be oriented at angles between 0 and 90 to the shank 224 and the longitudinal axis of the handle 110.

A link 240 has a first end pivotally connected to the release handle 232 by a pivot pin 242 at a point on the release handle 232 that is farther from the jaw body 234 than the pivot pin 236. The opposite second end of the link 240 fits into and pivotally sits in the recess 226 in the shank 224.

The second end of the link 240 abuts a stopper 250 that sits in the recess 226. The end of the shank 224 nearer the knob 222 can include a cylindrical passage 252, and the stopper 250 can fit inside the passage 252. In particular, the stopper 250 can be a screw that has a threaded engagement with the inside surface of the passage 252. One or more apertures 254 in the shank 224 between the knob 222 and the passage 252 expose a head 256 of the stopper screw 250. The apertures 252 permit a user to turn the stopper screw 250, and thus adjust the position of the stopper 250 along the shank 224. This sets the distance between the jaws 210*a*, 210*b* in the locked position.

A biasing spring 260 is connected between the jaw body 234 and a point on the shank 224 between the pivot pin 238 and the stopper 250. In the open position, the spring 260 applies a bias which tends to separate the jaws 210*a*, 210*b*. That is, the spring pulls on the jaw body 234 so that it tends to pivot counter-clockwise, which causes the paddle 210*b* to swing away from the paddle 210*a*.

In the open position, the pivot points 236, 238, 242 form a triangle with pivot point 236 closer to the shank 224 than the line between the pivot points 238 and 242, i.e., the triangle points toward the shank 224. To close the clamp 200, the handle 232 is pressed toward the shank 224. This causes the jaw body 234 to pivot clockwise, which causes the paddle 210*b* to swing toward the paddle 210*a*.

Once the pivot points 236, 238, 242 reach a straight line or slightly more (i.e., the triangle points toward the shank 224) the vice clamp 200 locks. That is, the amount of force needed to pry the handle 232 away from the shank 224 increases dramatically. A lever 270 can be pivotally mounted on the interior side of the lock/release handle 232. Pressing one end of the lever 270 toward the handle 232 causes the other end of the level 270 to press against the link 240 and thus urge the handle 232 away from the arm 220.

Figure 4:
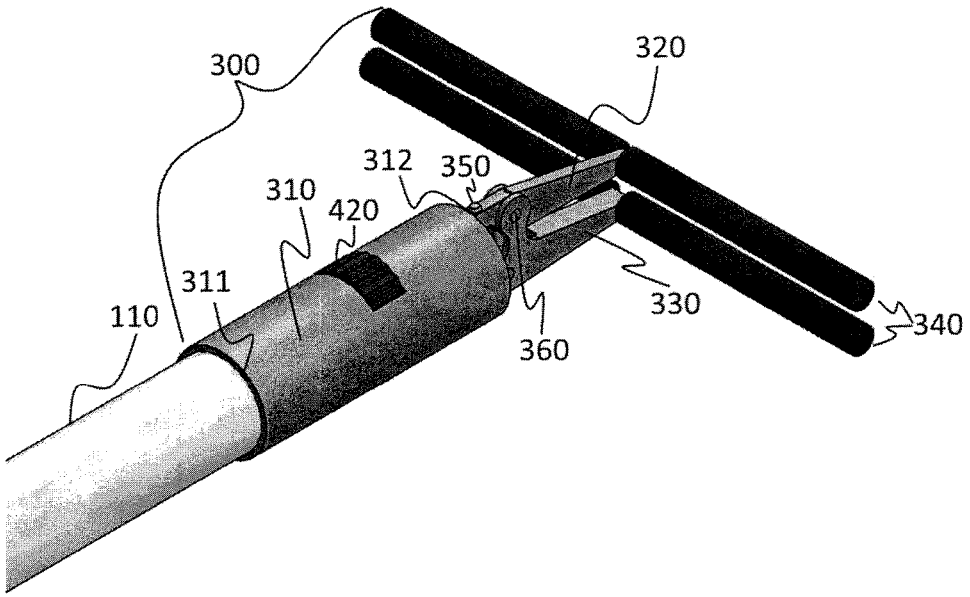
FIG. 4 is a schematic perspective view of another implementation of a mop.

FIG. 4 illustrates another embodiment of a mop 100 that includes a handle 110 and a locking vice clamp 300 at the bottom end of the handle 110 to manually secure and release a mop head. FIG. 4 illustrates the vice clamp 300 in a closed position. The vice clamp 300 includes a fixed jaw 320, a movable jaw 330, and a rotatable knob 420 to control spacing between the ends of fixed jaw 320 and movable jaw 330 when the vice clamp 300 is in the closed position.

The distal end of the fixed jaw 320 and the distal end of the movable jaw 330 ("distal" referring to the end farther from the handle 110 and "proximal" referring to the end closer to the handle 110) are attached to an elongated clamping surface 340. The clamping surfaces 340 can extend perpendicular to the longitudinal axis of the handle. To be secured, the mop head would be placed between the clamping surfaces 340. In some implementations the clamping surfaces 340 are cylindrical, although flat clamping surfaces are also possible. The clamping surface of the fixed jaw and/or the movable jaw can have ridges.

Figure 5:
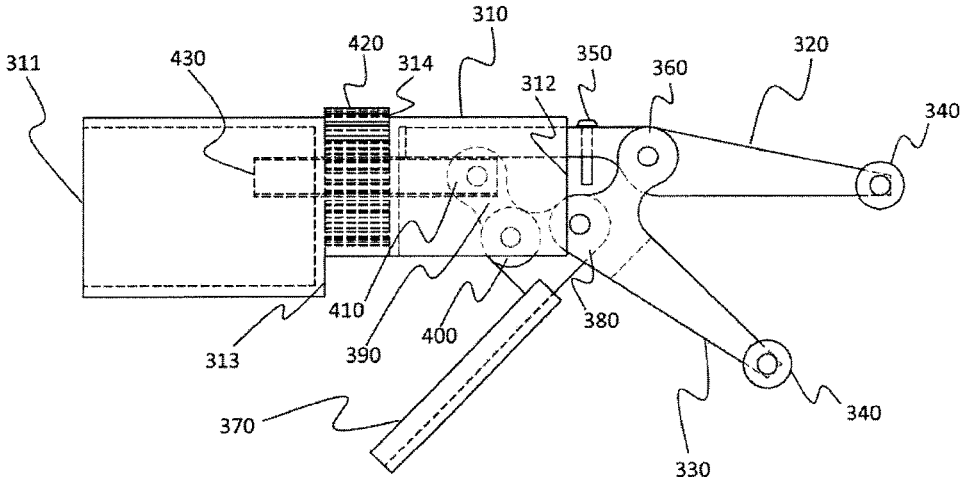
FIG. 5 is a schematic cross-sectional view of the vice grip portion of the mop of FIG. 4 in an open position.
Figure 6:
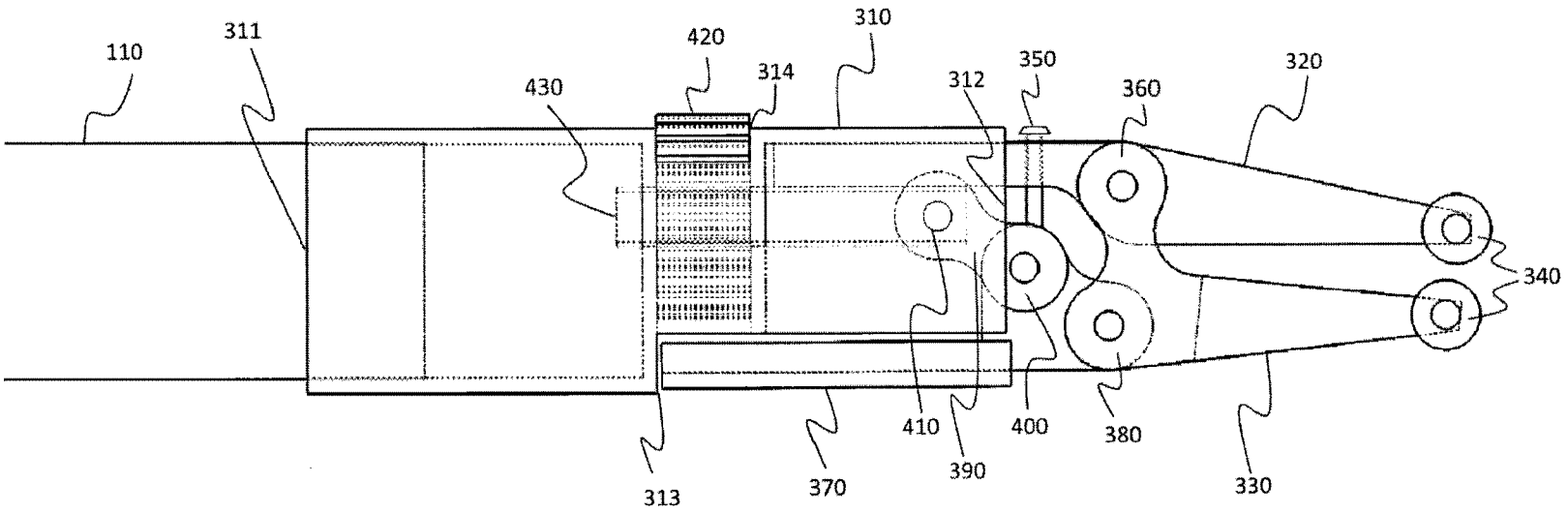
FIG. 6 is a schematic cross-sectional view of the vice grip portion of the mop of FIG. 4 in a closed position.

Referring to FIGS. 5 and 6, the vice clamp 300 includes a cylindrical sheath 310 with one end 311 that fits over and is fixed to the bottom end of the handle 110, e.g., molded, welded or secured with adhesive, screws or bolts. The sheath 310 includes an opening 312 on the end opposite the handle 110 in which a portion of the fixed jaw 320 is positioned. The sheath 310 also includes a slot 313 into which a lever 370 attached to the movable jaw 330 can fit, and an opening 314 for a rotatable knob 420. The side of the sheath 310 with the opening 313 for the lever 370 can be considered the "lower" side of the vice clamp 300 (as shown in FIGS. 5-6).

The fixed jaw 320 can be attached to the "upper" side of sheath 310, i.e., the side opposite the opening 313. In particular, a proximal end of the fixed jaw 320 can be held inside the opening 312, e.g., molded, welded or secured with adhesive, screws or bolts. The fixed jaw 320 has a hole through which a pin 350 fits.

The movable jaw 330 is pivotally attached to the fixed jaw 320 at a first pivot point 360. The movable jaw 330 is pivotally attached to a lever 370 at a second pivot point 380 at the proximal end of the movable jaw 330 and at the distal end of the lever 370. The lever 370 is also pivotally attached to a first end of a pivot pin 390 at a third pivot point 400. The third pivot point 400 can be located on the lever 370 slightly proximal the second pivot point 380. The pin 350 is positioned such that when the clamp 300 is closed, the lower end of the pin 350 rests against the third pivot point 400. The pivot pin 390 is pivotally attached at a second end 410 to a portion of the vice clamp 300 that remains stationary when the clamp is opened or closed. In some such embodiments, the second end 410 of the pivot pin 390 is attached to the rotatable knob 420 by a shank 430. The shank 430 can have an outer threaded surface which engages an inner threaded surface of the rotatable knob 420.

FIG. 5 illustrates a cross section of the vice clamp 300 in an open position. To close the vice clamp 300, the lever 370 is moved towards the sheath 310 in a clockwise manner. This causes the end of the pivot pin 390 having the third pivot point 400 to rotate counter-clockwise around the second end 410 of the pivot pin 390 (which is anchored to the shank 430). In addition, the constrain on the third pivot point 400 by the pivot pin 390 results in the distal end of the lever 370 being forced downwardly and distally. This movement causes the movable jaw 330 to rotate counter-clockwise around the first pivot point 360, which causes the distal end of the movable jaw 330 to approach the distal end of the fixed jaw 320, i.e., closing the vice clamp 300.

Once the pivot points 380, 400, and 410 reach a straight line or slightly more (i.e., the triangle points toward the pin 350) the vice clamp 300 locks. That is, attempting to pry apart the jaws 320, 330 will only force the third pivot point 400 on the lever 370 upwardly against a fixed surface, e.g., the fixed clamp 320, thus preventing the jaws 320, 330 from separating. In addition, the pivot point 400 moving into the locking position presses against the pin 350, causing the pin 350 to extend past the top of the sheath 310.

Before or after the clamp is in the closed position, the rotatable knob 420 can be used to adjust the spacing between the jaws. The rotatable knob 420 can be rotated to cause the shank 430 to move linearly toward or away from the handle 110. This pushes or pulls the pivot pin 390, which causes the spacing between the jaws 320, 330 in the closed position to increase or decrease.

FIG. 6 illustrates a cross section of the other embodiment of the vice clamp 300 in a closed position. To open the vice clamp 300, downward pressure is applied to the pin 350. This forces the third pivot point 400 down past the line between the second pivot point 380 and the pivot point 410 (so pivot points 380, 400, and 410 form a triangle that points away from the fixed jaw 320), thus unlocking the vice clamp 300. The lever 370 can then be pulled away from the sheath 310 in a counter-clockwise motion to further move apart the jaws.

A number of embodiments have been described. Nevertheless, it will be understood that various modifications may be made without departing from the spirit and scope of the invention. Accordingly, other embodiments are within the scope of the following claims.

What is claimed is:

1. A mop handle assembly, comprising:

a handle; and a locking vice clamp attached to a bottom end of the handle, the vice clamp having two jaws configured to hold a mop head, and a rotatable knob to adjust a spacing between the jaws in a closed position, wherein a first jaw of the two jaws is a fixed jaw and a second jaw of the two jaws is a movable jaw, wherein the vice clamp includes a lever pivotally attached to the movable jaw, wherein the vice clamp is configured such that rotation of the lever toward the handle moves the movable jaw toward the fixed jaw and sufficient rotation of the lever locks the vice clamp in the closed position, wherein the movable jaw is pivotally attached to the fixed jaw at a first pivot point, the lever is pivotally attached to the movable jaw at a second pivot point, and a first end of a pivot pin is pivotally attached to the lever at third pivot point, and a second end of the pivot pin is pivotally attached to a portion of the vice clamp that remains stationary when the lever is moved, and wherein a pin extends from the fixed jaw of the vice clamp and the vice clamp is configured such that pressure on the pin unlocks the locking vice clamp.

2. The mop handle assembly of claim 1, wherein the fixed jaw comprises a clamping surface that is elongated and is oriented substantially perpendicular to a longitudinal axis of the handle.

3. The mop handle assembly of claim 1, wherein the second end of the pivot pin is attached to the rotatable knob by a shank, the shank providing the portion that remains stationary when the lever is moved.

4. The mop handle assembly of claim 3, wherein the rotatable knob has an inner threaded surface and the shank has an outer threaded surface that engages the inner threaded surface of the rotatable knob such that rotation of the knob causes the shank to move linearly toward or away from the bottom end of the handle.

5. The mop handle assembly of claim 1, wherein the locking vice clamp includes a fixed arm and wherein the bottom end of the handle is secured to the fixed arm by one of being molded around the fixed arm, being welded to the fixed arm, being adhesively attached to the fixed arm, or a threaded engagement.

6. The mop handle assembly of claim 1, comprising the mop head.

7. The mop handle assembly of claim 6, wherein the mop head comprises a string mop head having a plurality of strings.

8. A mop handle assembly, comprising:

a handle; and a locking vice clamp attached to a bottom end of the handle, the vice clamp having two jaws configured to hold a mop head, a hollow sheath secured to the handle and having an opening through a wall of the sheath, a pin extending from a fixed jaw from the two jaws, a lever pivotally attached to a movable jaw from the two jaws such that rotation of the lever toward the handle moves the movable jaw toward the fixed jaw and sufficient rotation of the lever locks the vice clamp in a closed position, and a rotatable knob positioned in an interior of the sheath with an exposed portion extending through the opening, wherein the knob is rotatable about an axis parallel to a longitudinal axis of the handle, and wherein the knob comprises a threaded surface which engages a threaded surface of a shank that is connected to a pivot pin of the locking vice clamp such that rotation of the knob adjusts a spacing between the jaws in the closed position, and wherein the vice clamp is configured such that pressure on the pin unlocks the locking vice clamp.

* * * * *